US005634998A

United States Patent [19]

Schiedegger et al.

[11] Patent Number: 5,634,998

[45] Date of Patent: Jun. 3, 1997

[54] SHUTTER AND METHOD OF ASSEMBLING SAME

[75] Inventors: Charles E. Schiedegger, Metamora; Jack G. Wnuk, Lapeer, both of Mich.

[73] Assignee: Tapco International, Plymouth, Mich.

[21] Appl. No.: 465,741

[22] Filed: Jun. 6, 1995

[51] Int. Cl.[6] ..... E06B 7/08

[52] U.S. Cl. ..... 156/73.1; 52/473; 52/745.19

[58] Field of Search ..... 52/473, 745.19, 52/745.05; 156/73.1

[56] References Cited

U.S. PATENT DOCUMENTS

| | | | |
|---|---|---|---|
| 4,090,799 | 5/1978 | Crotti et al. | 52/656 X |
| 4,765,110 | 8/1988 | MacLeod | 52/473 |
| 4,858,400 | 8/1989 | Foyt | 52/423 X |
| 4,915,758 | 4/1990 | Baggett, Jr. et al. | 156/73.1 |
| 5,060,442 | 10/1991 | Chubb | 52/473 |
| 5,349,799 | 9/1994 | Schiedegger et al. | 52/473 |
| 5,459,972 | 10/1995 | Eckel | 52/456 |

*Primary Examiner*—Robert Canfield

*Attorney, Agent, or Firm*—Harness, Dickey & Pierce, P.L.C.

[57] ABSTRACT

A shutter apparatus and method of assembling same. The apparatus comprises a pair of elongated, outer support members and a plurality of center component sections which slidably engage channel portions of each of the outer support members. One or more spacer panels are included as well as one or more end members. The shutter apparatus is assembled by ultrasonically welding portions of the outer support members to side portions of each of the center components and the spacer panel, and to securing portions of the end members. By ultrasonically welding the various components of the shutter apparatus together rather than assembling same though the conventional use of staples and other like external fastening elements, the cost of assembly is reduced and the ability to re-use scrap component parts is made significantly easier and less costly.

10 Claims, 5 Drawing Sheets

34
10
36
18
39
20
36
24

FIG 4
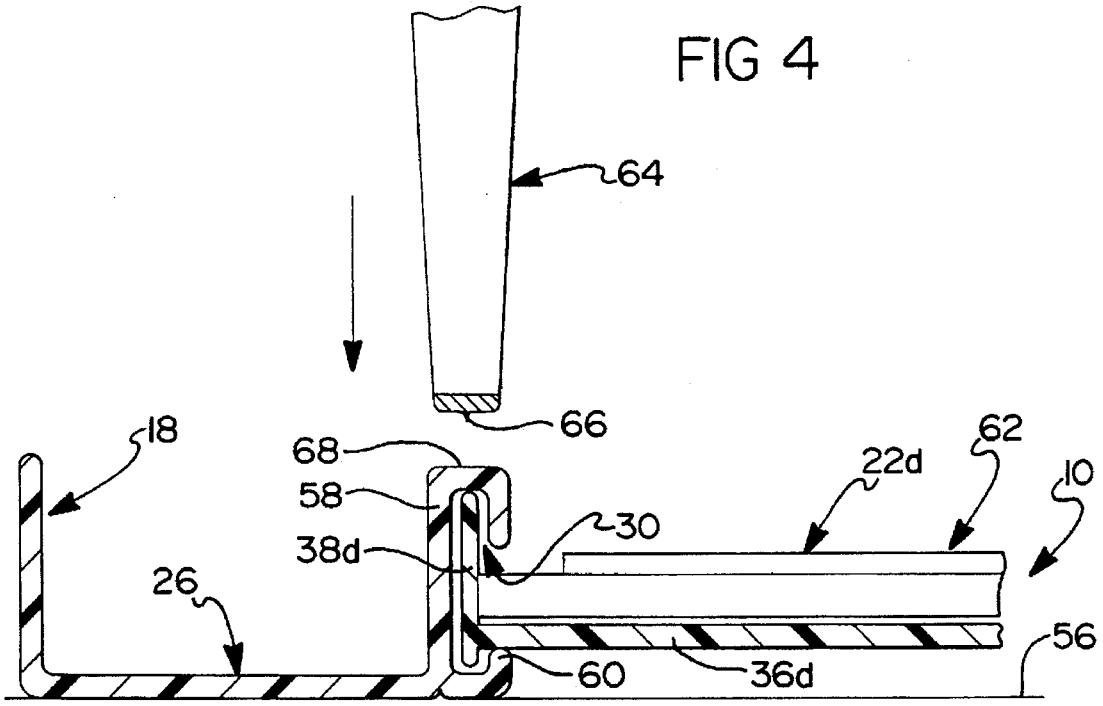
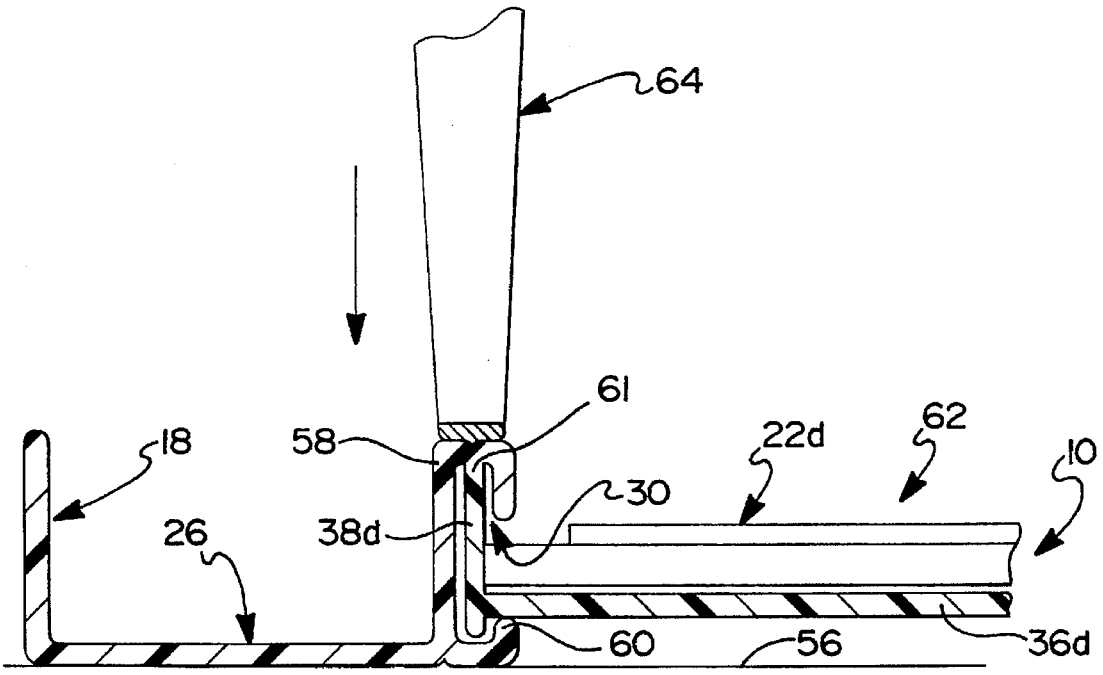
FIG 5

SHUTTER AND METHOD OF ASSEMBLING SAME

CROSS-REFERENCE TO RELATED APPLICATION

This application is related to U.S. patent application Ser. No. 08/468,192, entitled "Modular Shutter Assembly Including Die Cut Panel", filed concurrently herewith.

BACKGROUND OF THE INVENTION

1. Technical Field

This invention relates to decorative shutters for buildings such as commercial and residential dwellings, and more particularly to a component shutter apparatus which is secured together by ultrasonic welding techniques.

2. Discussion

Decorative shutters are used in a wide-variety of applications to provide an aesthetically pleasing appearance to buildings such as commercial and residential dwellings. Such shutters are typically placed on both sides of a window or a group of windows. Until recently, such shutters were typically made from wood, which necessitated periodic scrapping, priming and painting to maintain the attractive appearance of such shutters.

More recently, such shutters have been formed from a combination of injection molded component parts molded from high-strength plastics. Such component shutters have usually incorporated a pair of elongated side members and one or more louvers, spacers, and/or solid panels positioned between the side members. The various louvers, spacer panels, and/or solid panels have typically been secured to the side members via staples or some other form of mechanical, external fastening element. As will be appreciated, the use of external fastening elements to secure the various component parts of a component shutter assembly rigidly together introduces added costs due to the external fastening elements themselves, as well as frequently increasing the overall cost of manufacturing. Furthermore, if during assembly of the component shutter a mistake is made, the component parts involved cannot simply be discarded into a scrap bin for re-use due to the presence of the staples or other like metal fastening elements. Such elements must be removed from the scrap pieces before the scrap pieces may be re-used and molded into new component parts. This step alone introduces significant added manual labor to make sure that the staples or other like fastening members are removed from scrap materials before the scrap materials are further re-processed through typical molding techniques into new component shutter pieces.

It is therefore a principal object of the present invention to provide a component shutter apparatus which may be assembled quickly and easily without the use of external fastening elements such as staples, threaded screws or the like. It is a further object of the present invention to provide a component shutter apparatus and method of assembling same in which the individual component parts of the shutter apparatus are secured together solely by ultrasonic welding. In this manner, the need for any external fastening elements such as staples, threaded screws or the like is eliminated. Such a component shutter apparatus would also significantly ease the manner in which scrap individual component parts may be re-used since the manual step of removing the staples or other like external fastening elements prior to reusing the scrap component parts would be eliminated.

It is still another object of the present invention to provide a component shutter apparatus and method of assembling same in which the various component parts may be quickly and easily assembled by the use of a conventional ultrasonic welder to allow the assembly operation to be carried out by relatively unskilled workers.

SUMMARY OF THE INVENTION

The above and other objects are provided by a component shutter apparatus and method of assembling same in accordance with preferred embodiments of the present invention. The component shutter apparatus of the present invention generally includes a pair of elongated, outer support members each having a side portion forming a channel along at least a portion of a length thereof. One or more center components each having a side portion shaped so as to engage within an associated one of the channels of the elongated, outer support members is slidingly urged into the channels of the outer support members after the support members are positioned generally parallel to one another, and spaced-apart in accordance with the overall width of the center component.

In a preferred embodiment, one or more spacer panels are included which each have a pair of side portions at opposite ends thereof. The overall width of each spacer panel is preferably about the same as that of the center component and the side portions of each spacer panel are slidably engageable within the channels of the outer support members. During assembly, the side portions of the spacer panel are slidably engaged within the channels of the outer support members and the spacer panel slid along the channels until it abuts the center component. The channels of the outer support members (depending on the length thereof) allow one or more center components to be slidably inserted between the support members along with one or more spacer panels to thereby form an aesthetically pleasing, decorative appearance.

In the preferred embodiments, at least one end member is secured at one end of the outer support members. The end member includes a pair of securing portions and has an overall width which is about the same as the overall width of the component shutter apparatus, once the outer support members are secured to the center components and the spacer panel(s). The outer support members are further formed of a generally U-shaped configuration, and the securing portions of the end member are shaped so as to fit within the U-shaped portions of the outer support members. Once the end member is positioned in place during assembly, the securing portions thereof are ultrasonically welded to the outer support members.

Once the component shutter is completely assembled, the outer support members, the one or more center components, and the one or more end members are all secured to the outer support members by the use of ultrasonic welding at selected points along the outer support members. The ultrasonic welding is performed preferably from a rear side of each outer support member with the entire shutter flipped over on its front surface, such that the actual welding spots are not visible once the component shutter apparatus is installed on a building.

The method of assembling the component shutter of the present invention comprises slidably inserting the one or more center components and the one or more spacer panels within the channels of the outer support members, and securing the one or more end members to the outermost ends of each support member. Once the component shutter is completely assembled, a conventional ultrasonic welding tool is then used to ultrasonically weld the one or more center components, spacer panels and end members to the outer support members such that the finished shutter apparatus forms a single, unitary structure which is resistant to flexing and twisting forces. Furthermore, the fully assembled and welded shutter apparatus is held as a single piece component solely by the ultrasonic welds and therefore does not require any external staples or other like fastening elements during any assembly step.

It is also a significant advantage of the present invention that if a mistake is made during the assembly process which requires one or more component pieces to be scrapped, the additional manual step of physically removing one or more staples from one or more component parts is completely eliminated. Thus, the scrap component parts may be cut-up and/or melted down for re-use in the molding of new component parts without the added manual labor (and cost associated therewith) which would be necessary with component shutters held together by staples or other like fastening elements.

BRIEF DESCRIPTION OF THE DRAWINGS

The various advantages of the present invention will become apparent to one skilled in the art by reading the following specification and subjoined claims and by referencing the following drawings in which:

FIG. 4 is a cross-sectional side view of a portion of the component shutter of FIG. 2 showing a side portion of the center component slidably engaged within a channel of one of the outer support members, ready to be ultrasonically welded to the outer support member by an ultrasonic welding tool;

FIG. 5 shows the ultrasonic welding tool of FIG. 4 in the process of ultrasonically welding the side portion of the center component and the channel of the outer support member together.

DETAILED DESCRIPTION OF THE PREFERRED EMBODIMENTS

Figure 1:
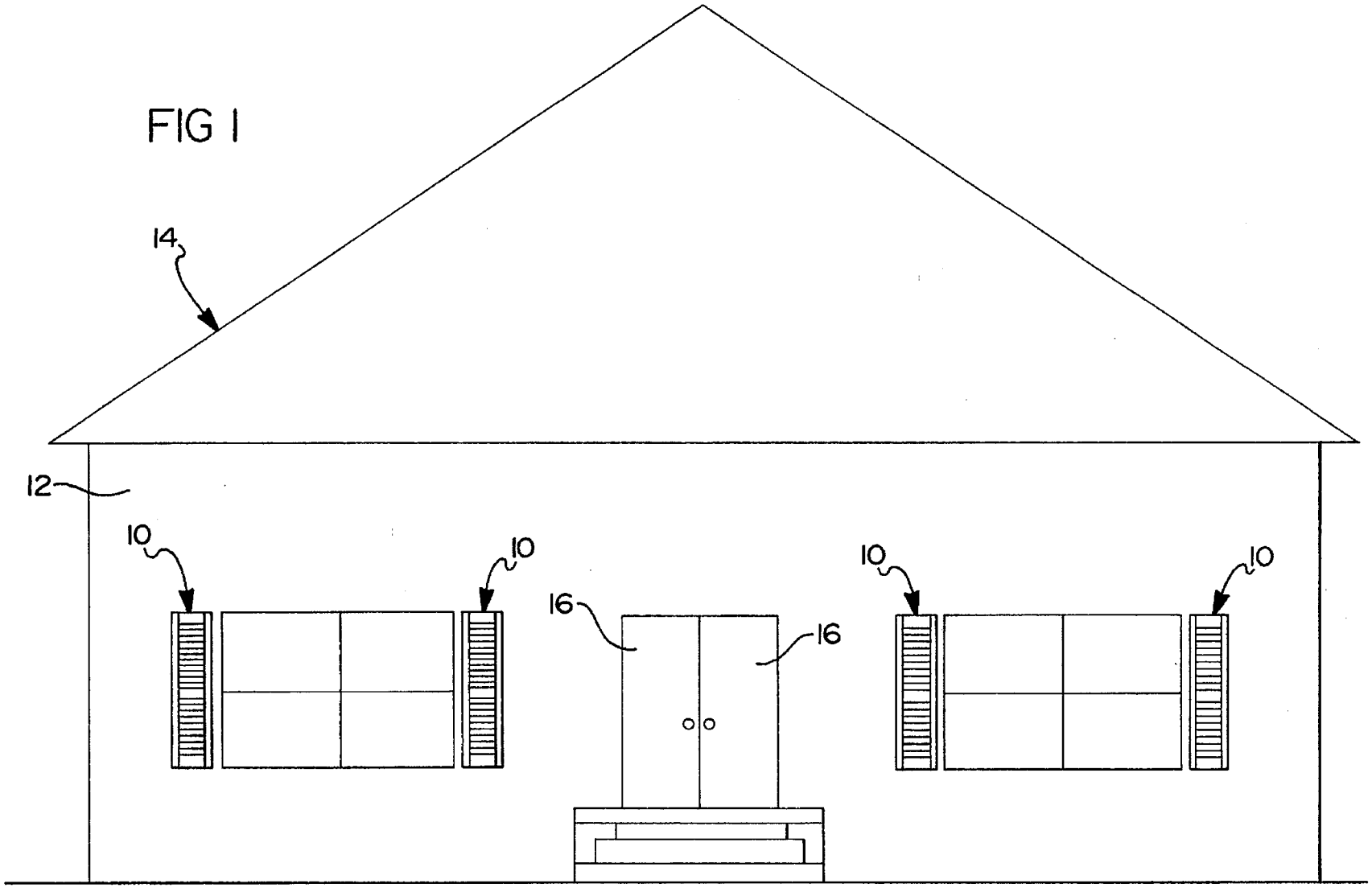
FIG. 1 is a front view of a building having a plurality of shutters in accordance with the method and apparatus of the present invention secured to an external surface thereof along opposite side of a pair of windows of the dwelling.

Referring to FIG. 1, there is shown a plurality of component shutter apparatuses 10 secured to an exterior surface 12 of a building such as a commercial or residential dwelling 14. For simplicity, the shutter apparatuses 10 will be referred to hereafter as "shutters 10". Typically, although not necessarily, the shutters 10 are secured on opposite sides of a window of the building 14. It will be appreciated, however, that the shutters 10 could be secured at other locations on the building 14 such as on opposite sides of the doorway 16, if so desired. The shutters 10 are held to the exterior surface 12 of the building 14 by any conventional means.

Figure 2:
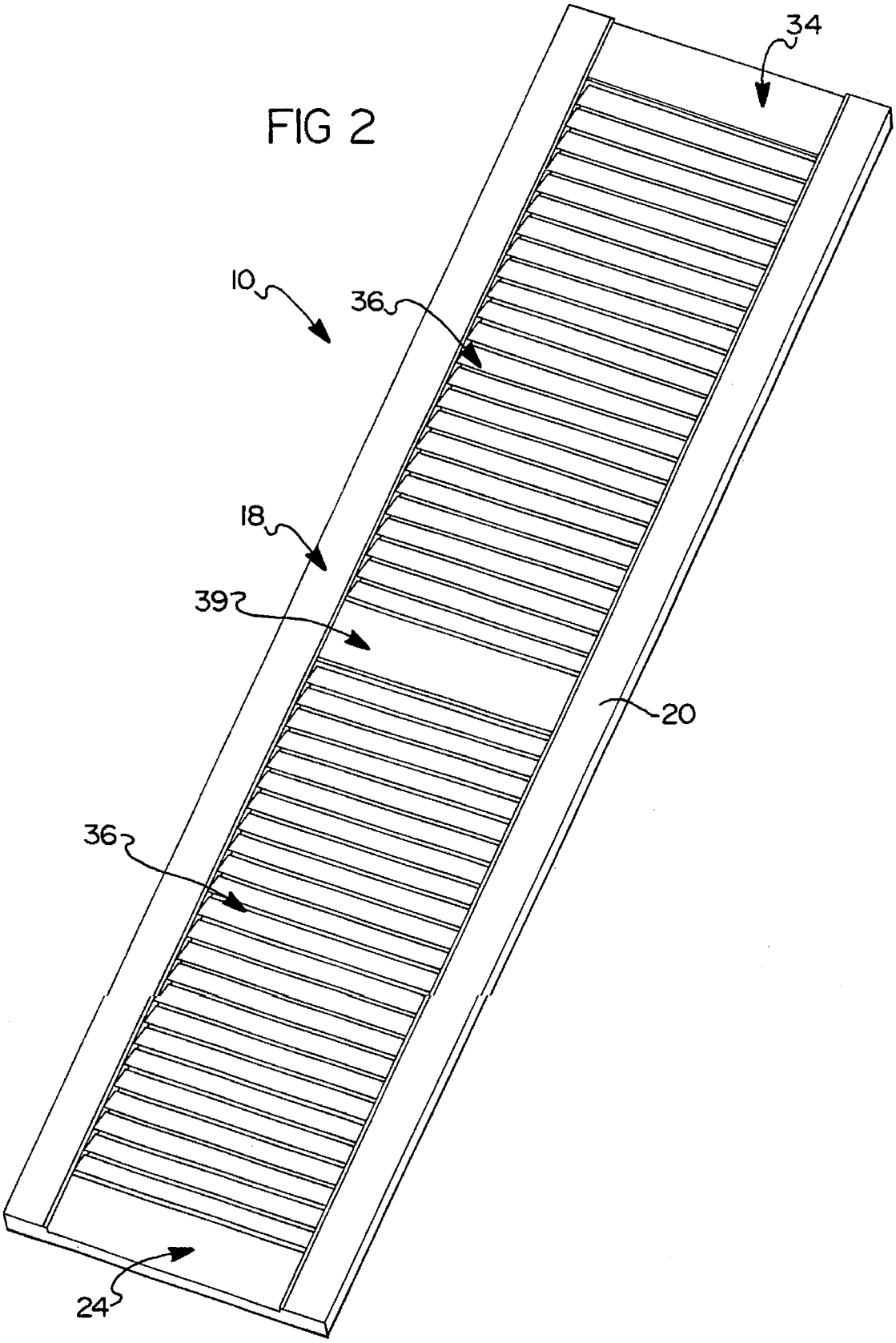
FIG. 2 is a perspective view of one of the shutters shown in FIG. 1.
Figure 3:
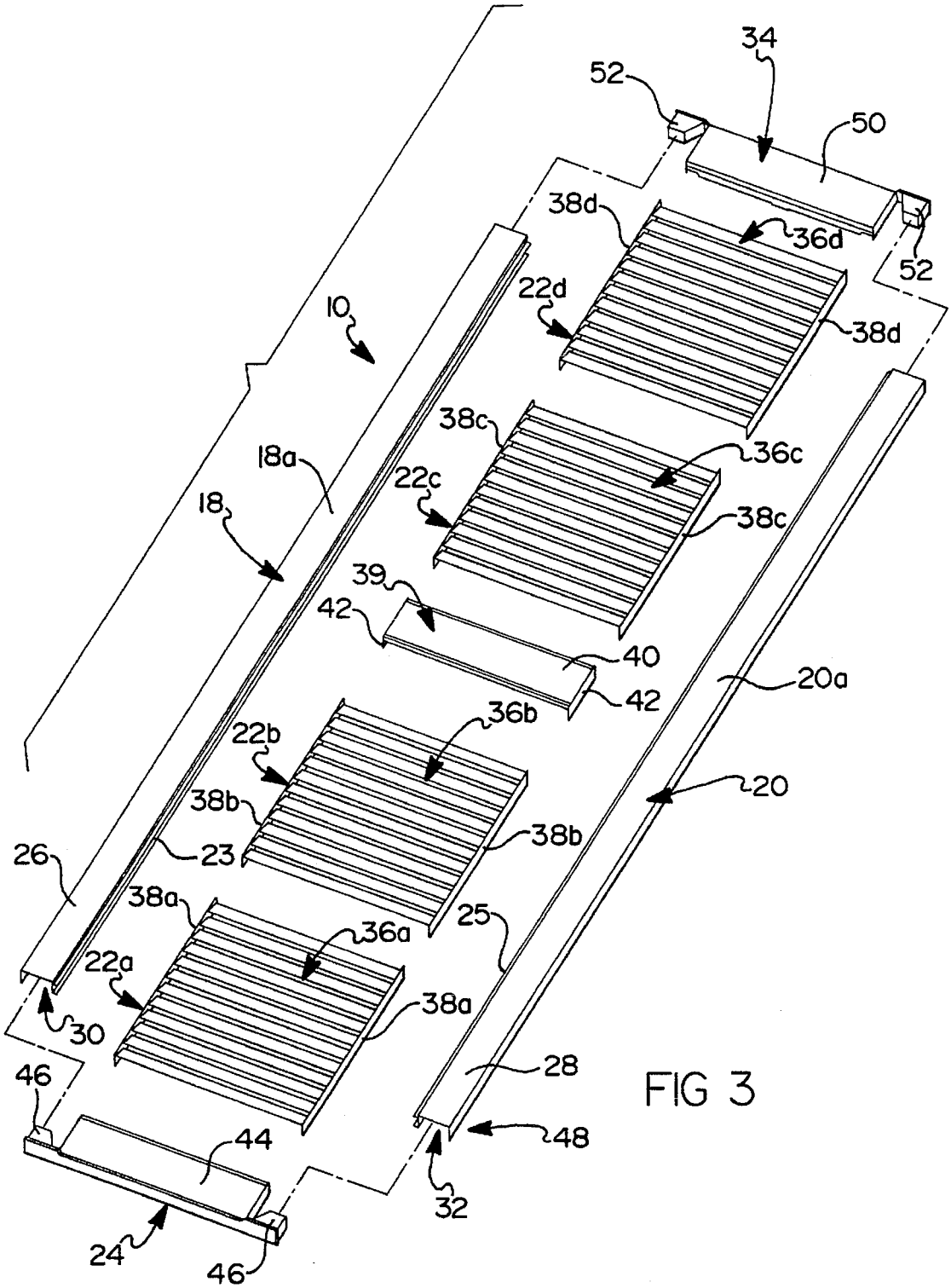
FIG. 3 is an exploded perspective view of the individual components of the shutter of FIG. 2 prior to the individual component parts being secured together in accordance with the method of assembly of the present invention.

Referring now to FIGS. 2 and 3, an enlarged view of one shutter 10 is shown. The shutter 10 is essentially identical in construction to the shutter disclosed in U.S. Pat. No. 4,765,110, assigned to the assignee of the present application, the disclosure of which is hereby incorporated by reference. With specific reference to FIG. 3, the shutter 10 is generally comprised of a first elongated, outer support member 18, a second elongated, outer support member 20, a plurality of center components **22*a*–22*d*, and at least a first end member 24. Each of the outer support members 18 and 20 have an internal side portion 23 and 25, respectively, as well as a generally U-shaped main body portion 26 and 28, respectively. The internal side portions 23 and 25 form channels 30 and 32, respectively. Each of the outer support members 18 and 20** may be injection molded or extruded from suitably high-strength thermal plastics such as polypropylene or polystyrene.

With further reference to FIG. 3, typically a second end member 34 is incorporated to form the shutter 10. It will be appreciated, however, that a greater or lesser number of center components **22*a*–22*d* could be included to form a shutter of widely varying lengths. Additionally, while each of the center components 22*a* and 22*b* is illustrated as a louver panel, it will be appreciated that one or more of the louver-style center components could be removed and a solid panel center component of the same overall outer dimensions inserted in its place. Accordingly, the component construction of the shutter 10 enables a variety of shutters to be assembled to provide different pleasing aesthetic appearances with a minimum number of individual component parts. When assembled together, the shutter 10 (as shown in FIG. 2) provides the appearance of a single, unitary, integrally formed member, with the center components 22*a* and 22*b* blending together to form the appearance of a single, elongated louver section, and the center components 22*c* and 22*d*** blending together to form the appearance of a second, elongated louver section.

With further reference to FIG. 3, each center component **22*a*–22*d* includes a central portion 36*a*–36*d*, respectively. At opposite width-wise sides of each central portion 36*a*–36*d* are formed a pair of elongated, transversely extending strip-like members 38*a*–38*d*, respectively. Each of the strip-like members 38*a*–38*d* are adapted to slidably engage within an associated one of the channels 30 or 32 of the outer support members 18 and 20**, as will be described in more detail momentarily.

With further reference to FIG. 3, at least one spacer panel 39, also known in the art as a "mullion", is preferably (but not necessarily) included to form the shutter 10. The spacer panel 39 (of which more than one may also be included) includes a central portion 40 and transversely extending side strip-like members 42 at opposite width-wise ends thereof. The spacer panel 39 is further of an overall width preferably identical to the width of the center components **22*a*–22*d*. The strip-like members 42 of the spacer panel 39 are also shaped so as to be slidably insertable within the channels 30 and 32 of the outer support members 18 and 20** during assembly.

With continued reference to FIG. 3, the first end member 24 also includes a central portion 44 and a pair of securing portions 46 formed at opposite width-wise ends thereof. Each of the securing portions 46 has overall outer dimensions which enable it to be inserted within the U-shaped main body portion 26 and 28 of each of the support members 18 and 20, respectively, at a lower end 48 of the assembled shutter 10, as indicated in FIG. 3. The second end member 34 is constructed identical to the first end member 24 and includes a central portion 50 and a pair of securing portions 52 which are adapted to engage within the U-shaped main body portions 26 and 28 of the outer support members 18 and 20 during assembly at an upper end 54 of the shutter 10. For aesthetic appeal, the second end member 34 could include a cathedral arch formed on its face. The second end member 34 provides a finished appearance to the upper end 54 of the shutter 10, as shown in FIG. 2.

With further reference to FIG. 3, the assembly of the components of the shutter 10 may be effected by first flipping over the two outer support members 18 and 20 so that the front faces 18*a* and 20*a* of each are positioned down against an assembly table or other like support surface, and aligning the two outer support members 18 and 20 at the approximate desired width-wise spacing from one another to accommodate the central components 22*a* and 22*b*, the one or more spacer panels 39, and the end members 24 and 34. The second end member 34 is likewise flipped over and its securing portions 52 are inserted into the U-shaped main body portions 26 and 28 of the outer support members 18 and 20. The center components 22*c* and 22*d* are likewise flipped over so that their outer surfaces are face down and assembled to the outer support members 18 and 20 by slidably inserting their side portions 38*a* and 38*b* into the channels 30 and 32 of the outer support members 18 and 20, respectively. The spacer panel 39, once flipped over so that its outer surface faces downwardly against the assembly table, may then be inserted such that its side portions 42 slidably engage the outer support members 18 and 20 until the spacer panel 39 is positioned abuttingly against the center component 22*c*. Thereafter, the two center components 22*a* and 22*b* may be assembled by flipping each over and sliding each such that their side portions 38*a* and 38*b*, respectively, slide along into the channels 30 and 32 until the center component 22*b* abuts against the spacer panel 39, and the center component 22*a* abuts against the center component 22*b*. At this point, the end member 24 may be secured to the outer support members 18 and 20 by flipping it over and inserting its securing portions 46 into the U-shaped main body portions 26 and 28 of the outer support members 18 and 20 until it abuts the center component 24*a*. The entire component shutter is thus assembled from the top down and with each component part having its outer, decorative face facing downwardly on the assembly table. In this manner, any slight longitudinal adjustment to the position of each component can he made prior to the components being permanently secured to one another. It will also he appreciated that the above-described assembly steps could he altered significantly without departing from the scope of the appended claims. For example, each of the center components 22*a*–22*d*, spacer panel 39, and the end members 24 and 34 could be slidably assembled to one of the outer support members, such as member 18, first, and subsequently the other support member 20 slid along the side portions 38*a*–38*d*, and the side portions 42 of the spacer panel 39, to thus enable the components to be assembled completely to first one support member 18 and then the other. Accordingly, the above-described specific sequence of assembly steps is not meant to be limiting, but merely rather an example of a preferred sequence of assembly steps.

Referring now to FIGS. 4 and 5, once the component shutter 10 has been completely assembled and the shutter 10 is positioned face down on an assembly table, indicated by reference numeral 56, the entire shutter 10 can be ultrasonically welded. The ultrasonic welding of the outer support member 18 to the center component 22*d* will be described first. It will be appreciated that this welding step is identical for each of the center components 22*a*–22*c*, as well as the spacer panel 39. With specific reference to FIG. 4, with the shutter 10 resting on the assembly table 56 in a face down orientation, the U-shaped main body portion 26 of the outer support member 18 opens upwardly. The channel 30 is formed in part by a C-member 58 and a lower lip member 60 which run preferably along the entire length of the outer support member 18. With reference to FIGS. 4 and 5, a conventional ultrasonic welding tool 64 having a tip portion 66 is then moved into contact with a planar portion 68 of the C-member 58, as indicated in FIG. 5, and held there for a predetermined length of time such as, for example, several seconds. The C-member 58 and the side portion 38*d* become ultrasonically welded together during this time period at point 61. After the predetermined time period has expired, the ultrasonic welding tool 64 is moved upwardly away from the C-member 58 and the welding tool 64 moved longitudinally along the internal side portion 22 of the outer support member 18 a predetermined distance. The welding tool 64 is then urged downwardly into contact with the C-member 58 and the operation is repeated.

Figure 6:
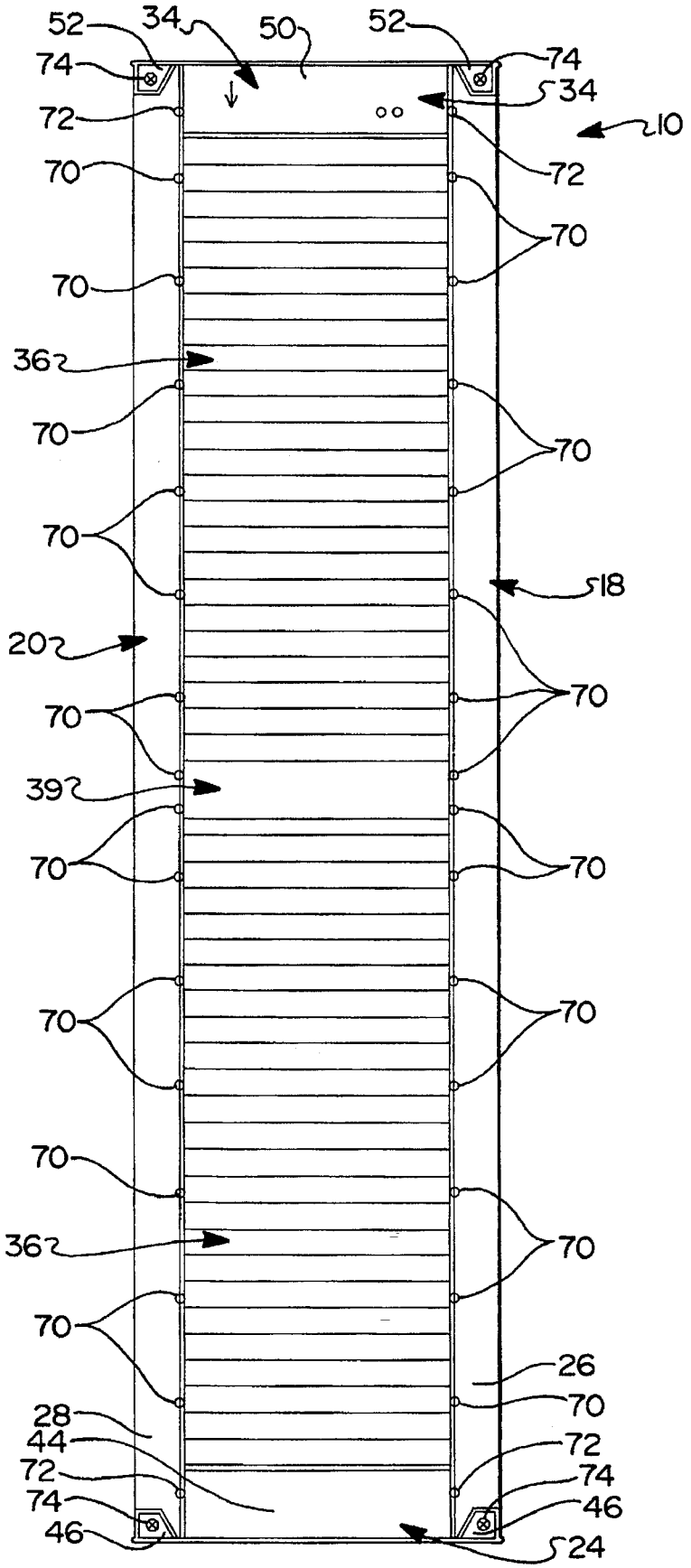
FIG. 6 is a rear view of the assembled shutter with small circled areas indicating an exemplary spacing of points at which ultrasonic welds are made during the assembly of the individual component parts of the shutter.

Preferably, a series of ultrasonic welds are made at spaced-apart locations along the entire length of the C-member 58. With brief reference to FIG. 6, an example of the spacing between the above-described ultrasonic welds is shown. The circled areas 70 indicate positions at which ultrasonic welds may be made. It will be appreciated, however, that a greater or lesser plurality of welds may be made to achieve a desired level of rigidity and solidness for the assembled shutter 10. When assembling the end members 24 and 34, ultrasonic welds may be made at the circled areas indicated by reference numeral 72 to secure the central portions 44 and 50 to the outer support members 18 and 20. Additional welds may be made at the locations indicated by reference numeral 74 to secure the securing portions 46 and 52 of each end member 24 and 34, respectively, to the U-shaped main body portions 26 and 28 of each outer support member 18 and 20, respectively. For a shutter 10 such as that shown in the drawings herein, and having an overall length of about 4 feet, generally about 20 to 30 ultrasonic welds are preferred to provide sufficient rigidity to the assembled shutter 10.

The shutter 10 and method of assembling same described herein thus provide a means by which the apparatus 10 may be quickly and easily assembled without the use of any staples or other like external fastening elements. Such fastening elements significantly hinder the re-use of the various components of the shutter 10 when such components become miss assembled, damaged during assembly or otherwise unsuited to produce the finished shutter 10, thus making it desirable to use the parts as scrap. With shutters assembled with staples or other like fastening elements, the tedious and time consuming (and costly) step of removing the individual staples from the individual component parts before same may be cut-up or otherwise re-used in new parts significantly hinders the re-use of scrap component parts.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for forming a component shutter without the use of external fastening element such as staples, threaded screws or other like members, the method comprising the steps of:

providing a pair of elongated, outer support members, each said outer support member having a side portion forming a channel along at least a portion of a length thereof, said channel having an exterior surface and an interior surface;

providing a center component having a pair of side portions adapted to slidably engage within said channel of each said elongated, outer support member, said side portions of said center component each having an exterior surface;

positioning said elongated, outer support members generally parallel to each other and a distance from one another in accordance with an overall width of said center component;

slidably urging said side portions of said center component into said channels of said elongated, outer support members, such that said exterior surface of each said side portion of said center component is in contact with said interior surface of said channel of each said side portion of each said elongated, outer support member; and ultrasonically welding said side portions of said center component within said channels of said elongated, outer support members by the application of ultrasonic welds spaced apart at points along a rear portion of said exterior surface of each said channel such that portions of said interior surface of each said channel are welded to portions of said exterior surface of each said side portion of said center component, to thereby secure said center component to said elongated, outer support members without the use of external fastening elements.

2. The method of claim 1, further comprising the steps of:

providing a spacer panel having side portions adapted to slidably engage within said channels of said elongated, outer support members between said elongated, outer support members;

urging said spacer panel towards said center component such that said side portions of said spacer panel engage within said channels of said elongated, outer support members, and continuing to urge said spacer panel toward said center support along said channels until said spacer panel abuts said center component; and ultrasonically welding said side portions of said spacer panel to said elongated, outer support members by applying ultrasonic welds to said exterior surface of each said channel to thereby maintain said spacer panel positioned abuttingly against said center support and fixedly secured to said elongated, outer support members.

3. The method of claim 2, further comprising the steps of:

providing a second center component, said second center component having side portions on opposite sides thereof and having an overall width enabling said side portions thereof to engage within said channels of said elongated, outer support members;

inserting said side portions of said second center component within said channels of said elongated, outer support member at ends of said elongated, outer support members opposite to the ends at which said center component was inserted;

slidably urging said second center component along said channels until said second center component abuts said spacer panel such that said spacer panel is positioned between said center component and said second center component; and ultrasonically welding said side portions of said second center component to said elongated, outer support members by applying ultrasonic welds to said exterior surface of said channels at spaced apart locations along said channels.

4. The method of claim 1, further comprising the steps of:

providing a first end member having securing portions at opposite ends thereof;

providing said elongated, outer support members each with a U-shaped main body portion;

urging said first end member toward said elongated, outer support members such that said securing portions of said first end member slidably engage within said U-shaped main body portion of each said elongated, outer support member; and ultrasonically welding said securing portions to said elongated, outer support members.

5. The method of claim 4, further comprising the steps of:

providing a second end member having securing portions at opposite ends thereof;

slidably inserting said securing portions of said second end member into said elongated, outer support members at an end of each of said elongated, outer support members opposite to that at which said first end member was inserted; and ultrasonically welding said elongated, outer support members to said securing portions of said second end member.

6. A method of forming a component shutter without the use of external fastening elements such as staples and threaded screws, said method comprising the steps of:

providing a pair of elongated, outer support members each having a channel formed along at least a portion of a length thereof and a main body portion, said channels each having an inner surface and an exterior surface;

providing a center component having side portions on opposite sides thereof adapted to slidably engage within said channels of said elongated, outer support members when said elongated, outer support members are positioned generally parallel to one another at a spacing in accordance with an overall width of said center component, each of said side portions having an exterior surface;

slidably inserting said side portions of said center component within said channels of said elongated, outer support members such that said inner surface of each said channel is in contact with said exterior surface of each said side portion and until a major portion of said center component is positioned between said elongated, outer support members; and ultrasonically welding said side portion of said center support to said channels of said elongated, outer support members by applying ultrasonic welds to said exterior surface of each said channel at a plurality of spaced-apart locations along a rear portion of each said elongated, outer support member such that said center support and said elongated, outer support members form a single, rigid, unitary structure.

7. The method of claim 6, further comprising the steps of:

providing a spacer panel having side portions at opposite sides thereof and an overall width in accordance with said width of said center support;

slidably inserting said side portions of said spacer panel into said channels of said elongated, outer support members;

continuing to urge said spacer panels slidably along said elongated, outer support members until said spacer panel abuts a portion of said center component; and ultrasonically welding said side portions of said spacer panel at spaced apart locations along said rear portion of each said elongated, outer support members.

8. The method of claim 7, further comprising the steps of:

providing an end member having a central portion and securing portions at opposite ends thereof;

urging said securing portions of said end member into engagement with said elongated, outer support members until said end member abuttingly engages a portion of said center component; and ultrasonically welding said end member to said elongated, outer support members at points along said rear portion of each said elongated, outer support member.

9. The method of claim 8, further comprising the steps of:

providing a second center component having side portions adapted to slidably engage within said channels of said elongated, outer support members;

slidably inserting said side portions of said second center component into said channels of said elongated, outer support members until said second center component abuts said spacer panels; and ultrasonically welding said side portions of said second center component to said elongated, outer support members at a plurality of spaced-apart location is along said rear portion of each said elongated, outer support member.

10. The method of claim 8, further comprising the steps of:

providing a second end member having a central portion and a pair of spaced-apart securing portions adapted to interengage with said elongated, outer support members;

urging said securing portions into engagement with said elongated, outer support members such that said end member rests flush against outermost ends of said elongated, outer support members; and ultrasonically welding said elongated, outer support members to said second end member at a point on a rear portion of each of said elongated, outer support members.

* * * * *